US010527015B2

(12) United States Patent
Miny et al.

(10) Patent No.: US 10,527,015 B2
(45) Date of Patent: Jan. 7, 2020

(54) CONNECTOR ASSEMBLY FOR A FUEL INJECTOR

(71) Applicant: DELPHI TECHNOLOGIES IP LIMITED, St. Michael (BB)

(72) Inventors: Eric Miny, Chailles (FR); Jean-Etienne Blanc, Chatelaillon-Plage (FR); Xavier Lale, Vendome (FR); Samuel Sarmezan, Ezanville (FR); Fabrizio Bonfigli, Mont pres Chambord (FR)

(73) Assignee: DELPHI TECHNOLOGIES IP LIMITED (BB)

( * ) Notice: Subject to any disclaimer, the term of this patent is extended or adjusted under 35 U.S.C. 154(b) by 154 days.

(21) Appl. No.: 15/309,241

(22) PCT Filed: Mar. 25, 2015

(86) PCT No.: PCT/EP2015/056388
§ 371 (c)(1),
(2) Date: Nov. 7, 2016

(87) PCT Pub. No.: WO2015/169500
PCT Pub. Date: Nov. 12, 2015

(65) Prior Publication Data

US 2017/0067428 A1 Mar. 9, 2017

(30) Foreign Application Priority Data

May 7, 2014 (GB) ..... 1408060.0

(51) Int. Cl.

| | |
|---|---|
| ***F02M 51/00*** | (2006.01) |
| ***F02M 55/00*** | (2006.01) |
| ***F02M 61/16*** | (2006.01) |

(52) U.S. Cl.
CPC ..... *F02M 51/005* (2013.01); *F02M 55/002* (2013.01); *F02M 55/004* (2013.01); *F02M 61/168* (2013.01); *F02M 2200/8084* (2013.01)

(58) Field of Classification Search
CPC .. F02M 51/005; F02M 55/002; F02M 55/004; F02M 61/168; F02M 2200/8046;
(Continued)

(56) References Cited

U.S. PATENT DOCUMENTS 4,834,295 A * 5/1989 Cristiani ..... F02M 51/005 239/585.5
4,922,880 A * 5/1990 Seibt ..... F02F 7/006 123/470

(Continued)

FOREIGN PATENT DOCUMENTS

| | | |
|---|---|---|
| EP | 1130249 A2 | 9/2001 |
| EP | 1533517 A2 | 5/2005 |
| WO | 2012052295 A1 | 4/2012 |

*Primary Examiner* — Darren W Gorman
*Assistant Examiner* — Steven M Cernoch
(74) *Attorney, Agent, or Firm* — Joshua M. Haines

(57) ABSTRACT

An electrical connector assembly of a fuel injector includes a body with external walls defining an internal volume and an internal wall dividing the connector in a first part adapted to be fixed in a complementary engagement with the body of the injector and, in a second part adapted to receive another electrical connector. The electrical connector assembly also includes at least one electrical terminal extending through the internal wall from an inner extremity protruding in the inner volume of the first part of the body, to an outer extremity protruding in the outer volume of the second part of the body. The outer extremity is shaped to receive in a complementary engagement an electrical terminal of said another electrical connector. The connector assembly is adapted to be in fluid communication with the back leak return conduit of the injector.

21 Claims, 5 Drawing Sheets

(58) Field of Classification Search
CPC ... F02M 2200/8038; F02M 2200/8084; F02M 2200/9038
USPC ..... 239/585.1–585.5; 123/472; 439/130; 701/103
See application file for complete search history.

(56) References Cited

U.S. PATENT DOCUMENTS

| | | | | | |
|---|---|---|---|---|---|
| 4,971,291 | A * | 11/1990 | Cristiani | F02M 51/0667 | 239/124 |
| 4,988,073 | A * | 1/1991 | Cristiani | F02M 51/005 | 239/585.1 |
| 5,226,391 | A * | 7/1993 | Gras | F02M 51/005 | 123/456 |
| 5,323,749 | A * | 6/1994 | Gras | F02M 51/005 | 123/470 |
| 5,479,900 | A | 1/1996 | Bodenhausen et al. | | |
| 6,279,842 | B1 * | 8/2001 | Spain | F02M 51/005 | 239/102.2 |
| 8,100,344 | B2 * | 1/2012 | Kondo | F02M 47/027 | 123/480 |
| 8,224,554 | B2 * | 7/2012 | Kondo | F02M 57/005 | 123/456 |
| 9,822,744 | B2 * | 11/2017 | Bimbenet | F02M 51/005 | |
| 2008/0185461 | A1 * | 8/2008 | Fleig | F02M 51/005 | 239/585.1 |
| 2009/0008483 | A1 | 1/2009 | Renner | | |
| 2009/0118983 | A1 | 5/2009 | Kondo et al. | | |
| 2013/0193228 | A1 * | 8/2013 | Bimbenet | F02M 51/005 | 239/124 |

* cited by examiner

CONNECTOR ASSEMBLY FOR A FUEL INJECTOR

CROSS REFERENCE TO RELATED APPLICATIONS

This application is a national stage application under 35 USC 371 of PCT Application No. PCT/EP2015/056388 having an international filing date of Mar. 25, 2015, which is designated in the United States and which claimed the benefit of GB Patent Application No. 1408060.0 filed on May 7, 2014 the entire disclosures of each are hereby incorporated by reference in their entirety.

TECHNICAL FIELD

The present invention relates to an electrical connector assembly for a fuel injector and also to the fuel injector equipped with such connector.

BACKGROUND OF THE INVENTION

A fuel injector is provided with an actuator arranged in its body and which electrical wires upwardly extend in an axial bore of the injector body. The bore is a blind hole and the wires protrude through a seal arranged in the wall of the body to be electrically connected into an electrical connector. Said connector has a plastic body and metallic electrical terminals which are at one end connected to the wires of the actuator and, at the other end, adapted to receive a complementary connector. The fuel injector is also provided with a back leak flow channel wherein fuel, at low pressure, flows from a control valve toward a low pressure reservoir. The injector is provided with an outlet pipe radially protruding from the injector body. In certain injectors the axial bore of the injector, wherein are the wires, is part to said back leak channel and, in use, fuel wets said wires.

The manufacturing and assembly of the injector raises numerous difficulties such as manufacturing of the blind bore, of the outlet pipe, the fixation of the connector onto the injector body or the electrical connection of the wires on the terminals.

SUMMARY OF THE INVENTION

Accordingly, it is an object of the present invention to provide a connector assembly and a complete injector solving at least partially the above problems.

In carrying out the above object and other objects, features, and advantages, the present invention provides an electrical connector assembly of a fuel injector extending along a first axis. The connector has a body with external walls defining an internal volume and an internal wall dividing the connector in a first part adapted to be fixed in a complementary engagement with the body of the injector and, in a second part adapted to receive another electrical connector. The electrical connector assembly further comprises at least one electrical terminal extending through the internal wall, along a second axis, from an inner extremity protruding in the inner volume of the first part of the body to an outer extremity protruding in the outer volume of the second part of the body. The outer extremity is shaped to receive in a complementary engagement an electrical terminal of said another electrical connector.

The connector assembly is adapted to be in fluid communication with the back leak return conduit of the injector so that, in use, fuel may enter the inner volume of the first part of the body and wet the electrical terminal.

The inner volume of the first part of the body is substantially cylindrical extending along the first axis from a lower extremity and it is adapted to engage the body of the injector to an opposite upper extremity. The cylindrical volume opens at both extremities, the connector assembly further comprising a sealing cover adapted to seal the upper extremity.

The connector assembly may further be provided with an outlet pipe integral to the connector body and adapted to be in fluid connection with the internal back leak channel of the injector. Alternatively, the outlet pipe may be integral to the sealing cover.

The central portion of the terminal that extends through the internal wall is cylindrical or conical.

The connector assembly further comprises sealing means arranged between the central portion of the terminal and the internal wall so that the inner and outer volumes, of the first and of the second parts are sealed from each other.

The inner extremity of the terminal is integral to the central portion and is made in a first conductive material and, the outer extremity is non-integral and is fixed to the central portion, the outer extremity being made in a second conductive material.

In another alternative, the inner and the outer extremities of the terminal are both integral to the central portion and are all made in a first conductive material.

The first material is free of Cu and of Zn or, alternatively, the first material is externally coated with a coating free of Cu and of Zn.

The connector assembly may further comprise locking means adapted to maintain in position the terminal relative to the connector body.

The locking means comprise first locking means for locking the terminal in rotation about the second axis and also, second locking means for locking the terminal in translation along said second axis.

The locking means may be a complementary engagement of a portion of the terminal, such as a groove, and of part of the sealing cover, such as a fork-like feature or a notch.

The locking means may comprise a sub-assembly of the terminal complementary engaged in a holding part, said sub-assembly being over-molded in the connector body.

The connector may further comprise connector locking means adapted to fix the connector assembly on the injector body.

In an embodiment, the connector body is plastic molded and the locking means comprise at least one metal insert fixed the body and axially protruding from said plastic body at the periphery of the lower extremity.

The at least one metal inserts may be over molded in the connector body, or may be glued on the outer periphery of the connector body or may be crimped on the periphery of the connector body by a circling collar.

The invention further extends to a fuel injector having a body extending along a first axis, an actuator arranged in said body and a connector assembly arranged on said body, the injector body having an internal bore in which at least one electrical lead extends from the actuator to the connector assembly wherein it is electrically connected to an electrical terminal, the internal bore being part of a back leak return channel in witch, in use, low pressure fuel may flow toward an outlet. The connector assembly is as set in the preceding lines and, the inner volume of the first part of the connector assembly is in fluid communication with the internal bore of the injector body so that, in use, fuel may enter the inner volume of the connector and wet the electrical terminal.

More specifically, in an embodiment, the outlet is arranged integral to the connector assembly. In another embodiment, the outlet is arranged integral to a sealing cover adapted to seal the connector body.

The electrical wires may be laser welded on the inner extremity of the terminal.

The injector body has a male cylindrical portion that engages in a complementary female lower extremity of the connector body and, the injector body is provided with an annular groove in which are bent the protruding part of the metal insert so that, the connector assembly is fixed in position on the injector body.

The injector body has a male cylindrical portion that engages in a complementary female lower extremity of the connector body and, the injector body is provided with an annular disc face transversal to the first axis, the protruding part of the metal insert being welded on said disc-face so that, the connector assembly is fixed in position on the injector body.

The injector body has a male cylindrical portion that engages in a complementary female lower extremity of the connector body, both the connector body and the injector body being provided with complementary aligned radial holes, and in which is inserted a pin so that, the connector assembly is fixed in position on the injector body.

The invention further extends to a method for assembling a fuel injector as set in the preceding lines. The method comprises the following steps:

- providing a cylindrical fuel injector body extending along a longitudinal axis and having an internal bore opening at an extremity of the body,
- providing a connector assembly as set in claim,
- arranging in said body an actuator, the electrical wires connecting the actuator extending in said bore and exiting through said bore opening,
- assembling on said extremity of the bore the body of the connector assembly,
- fixing said body onto the body of the injector, for instance by, bending the protruding metal inserts or by welding said metal insert or by inserting a radial pin in a complementary hole extending in the connector body and in the injector body,
- placing the terminal by engaging the central portion through a bore of the internal wall of the connector body,
- connecting the inner extremities of the terminal to the wires of the actuator, for instance by welding, the welding tools engaging through the open upper extremity of the connector body,
- placing the sealing cover on said upper extremity so that, the terminal is locked in place by complementary engagement of part of the cover and part of the terminal and, so that the cover sealingly closes said upper extremity.

BRIEF DESCRIPTION OF THE DRAWINGS

The present invention is now described by way of example with reference to the accompanying drawings in which.

DESCRIPTION OF THE PREFERRED EMBODIMENTS

To ease and clarify the following description the top-down orientation of the figures is arbitrarily chosen and, words and expressions such as "above, under, over, below . . . " may be utilized without any intention to limit the invention.

Figure 1:
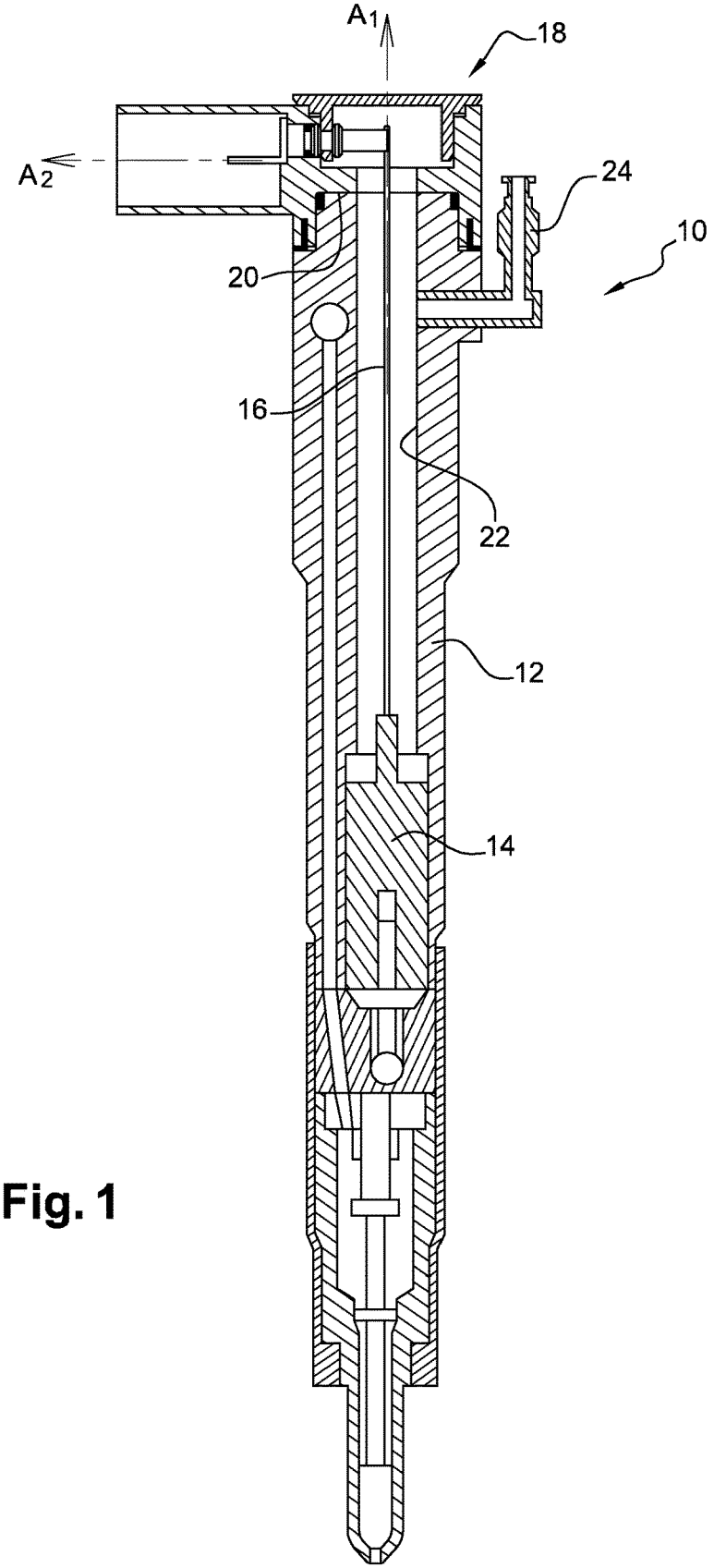
FIG. 1 is an axial section of an injector equipped with a connector as per the invention.

In reference to FIG. 1, a fuel injector 10 has a body 12, extending along a longitudinal axis A1, and in which is fixedly arranged an actuator 14 electrically connected to a control unit, not represented, via electrical leads 16 upwardly extending toward an electrical connector assembly 18 arranged on the upper end 20 of the injector body 12.

As well known, the fuel injector 10 is also provided with a control valve, a nozzle and high pressure fuel channels in which in use, fuel flows from an inlet to the nozzle. This will not be discussed further as not being part of the core of the invention.

Above the actuator 14, the body 12 is provided with a bore 22 that upwardly axially extends and opens in the top end face 24 of the body 12. The axial bore 22 is part of a back leak channel enabling low pressure fuel to flow out of the injector 10, via an outlet pipe 26, and then return to a low pressure reservoir. A L-shape outlet pipe 26 is represented in FIG. 1, the horizontal leg fluidly connecting to the bore 22 and, the vertical leg upwardly orienting the pipe 26 which at its extremity is provided with features for complementary engagement with a, non-represented, return conduit.

On the upper end 20 of the injector 10 is arranged the connector assembly 18 more detailed in the following figures. The connector 18 comprises a plastic body 28 having external envelop 30 and an internal wall 32 that separates the connector 18 in a first part 34, complementary arranged on the upper end 20 of the injector body 12 and, in a second part 36 adapted to receive another connector, so that the actuator 14 can be electrically connected to the control unit.

The first part 34 is substantially cylindrical extending on the top of the injector body 12 along the longitudinal axis A1 and defining a cylindrical inner volume 38.

The second part 36 extending along a second axis A2 perpendicular to the longitudinal axis A1 and defines an outer volume 40 shaped to receive the complementary connector, not represented. Alternative constructions where the two axes A1, A2, are not perpendicular are also possible.

The interface between the first part 34 of the connector body 28 and the injector body 12 is a male-female cylindrical engagement along the longitudinal axis A1 where the lower extremity 42 of said first part 32 engages over the upper end 20 of the injector body 12. More in details, the injector body 12 has, from its top end face 24, a male cylindrical face 44 downwardly extending until joining a transversal a radial disc-face 46 and, the first part 34 of the connector body 28 is provided with a complementary lower recess 48 having a female cylindrical wall 50 and a transversal ceiling wall 52 centrally holed.

The ceiling wall 52 divides the inner volume 38 into said lower recess 48, below the ceiling 52, and an upper recess 54, above the ceiling wall 52. The connector body 28 is further provided with at least one over-molded metal insert 56 downwardly protruding out of the plastic envelop 30 and being, as shown on FIG. 2, outwardly bent so that, they contact the radial disc-face 46 of the injector body 12. The protruding part of the metal inserts 56 are laser welded on said disc-face 46 so the connector 18 is permanently fixed to the injector body 12.

Alternatively, the metal insert 56 could be bent inwardly or could be not bent at all, provided they enable fixation of the connector. Alternative means of fixation will be further described.

The assembly of the connector onto the injector body 12 is sealed by an O-ring 58 arranged between the cylindrical face 44 and the female cylindrical wall 50 or between the top end face 24 and the ceiling wall 52. A specific groove may be provided to accommodate the O-ring or by any other sealing means such as sealing paste, gasket . . . .

Opposite to the lower extremity 42 is the open upper extremity 60 of the first part of the connector body 28. Said upper extremity 60 defines the upper recess 54 mentioned above.

On the top of the upper extremity 60 is arranged a sealing cover 62 that closes the upper opening of the connector body 28. The cover 62 comprises a circular main face 64 transversal to the longitudinal axis A1, from which extends a cylindrical centering wall 66 that complementary engages in the connector body 28. When in place the sealing cover 60 may be laser welded to ensure sealing of the interface.

The connector assembly 18 also comprises a plurality of electrical terminals 68. Only one is represented on FIG. 2. It is inserted along the second axis A2 through a bore 70 provided in the internal wall 32 of the connector body 28. The terminal 68 extends from an outer extremity 72 protruding in the outer volume 40 to an inner extremity 74 protruding in the upper recess 54.

Figure 3:
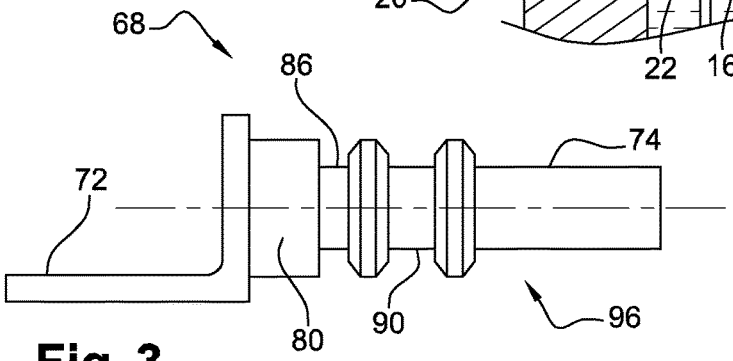
FIGS. 3 and 4 are views of an electrical terminal of the connector assembly of FIG. 2.
Figure 4:
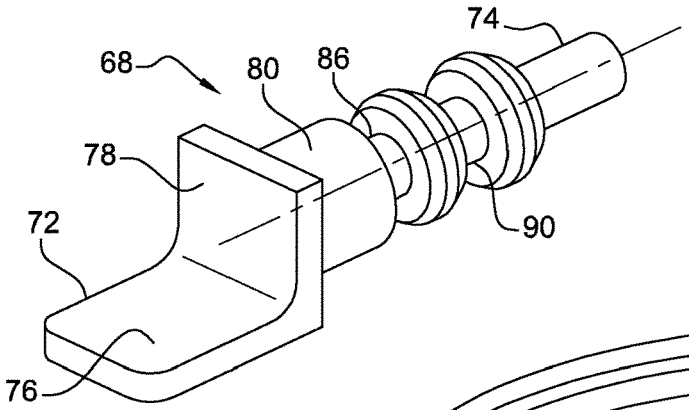

More in detail and, in reference to FIGS. 3 and 4 where an embodiment of terminal is represented, the outer extremity 72 of the terminal 68 is an L-shape flat metal sheet having a horizontal portion, forming a rectangular flat pin 76 and, a connection portion 78, represented vertical. As it is indeed designed to match a complementary pin of the complementary connector, said rectangular pin 76 could very well take any other required shape, for instance in having a cylindrical or a square section. The vertical connection portion 78 enables an intimate electrical connection with a central cylindrical portion 80 of the terminal 68 that extends through the internal wall 32 and protrudes in the lower recess 48 extending until the inner extremity 74.

In place in the connector body 28, the vertical connection portion 78 of the terminal lies against the outer face of the internal wall 32 where it engages a small recess 82 complementary shaped to the connection portion 78, said engagements creates rotation locking means 84 preventing the terminal to rotate about the second axis A2.

As visible on the figures, said cylindrical portion 80 comprises a first groove, that is a sealing groove 86, wherein is arranged another O-ring 88 sealing across the bore 70 of the internal wall 32. Other sealing means such as paste, gasket or tight press fit are also possible alternatives.

Figure 5:
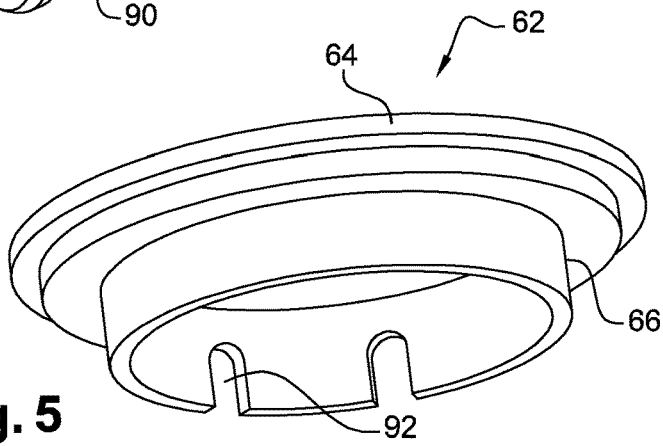
FIG. 5 is the sealing cap of the connector assembly of FIG. 2.

The cylindrical portion 80 is further provided with a second groove, that is a locking groove 90, in which engages a notch 92 provided in the centering wall 66 of the cover 62. In FIG. 5 is a representation of an embodiment of the cover 62 where two notches 92 are being provided in the centering wall 66 for complementary engagement with the locking grooves 90 of two terminals 68. This complementary engagement of the notch 92 in the locking groove 90 constitutes translation locking means 94 along the second axis A2, preventing the terminal 68 to slide within the bore 70 of the internal wall 32. Between the locking groove 92 and the inner extremity 74, the terminal comprises a final section 96 represented cylindrical on the figures but which can alternatively take any other shape.

In use as represented on the figure, the inner extremity 74 of the terminal is substantially in the center of the upper recess 54 where end the electrical leads 16 of the actuator 14 and, connection such as laser welding is made.

Figure 2:
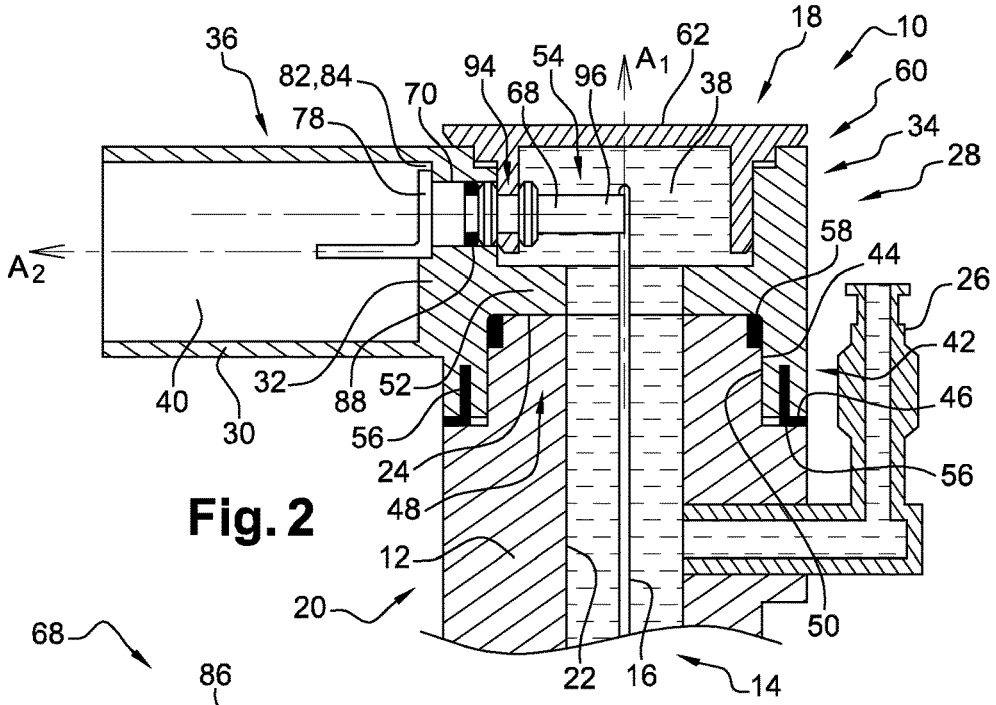
FIG. 2 is detailed view of the connector assembly of FIG. 1.
Figure 6:
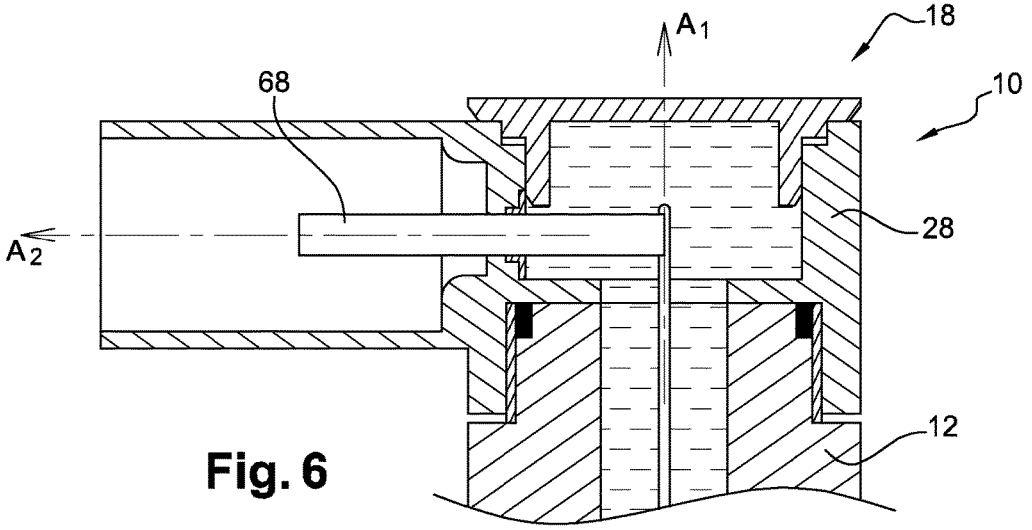
FIG. 6 is a second embodiment of the connector assembly.
Figure 7:
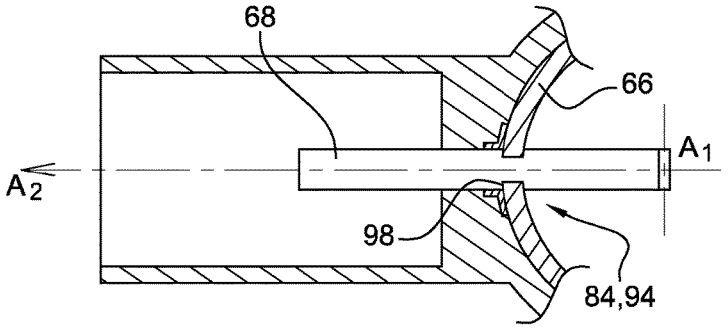
FIG. 7 is a top section of the second embodiment of FIG. 6.

On the embodiment represented on FIG. 2, the rectangular pin 74 is centered in the outer volume 40 of the connector body 28 while the second axis A2 of the central portion 80 is parallel and offset. Alternatively, other shapes are possible for the terminal 68. For instance, in reference to FIGS. 6 and 7, a flat terminal 68, having a constant rectangular section, is made integral in one piece and, it extends through a rectangular bore of the internal wall 32 and protrudes from both sides of the internal wall 32. The flat terminal 68 is provided with two opposite side notches 98 in which complementary engage part of the centering wall 66 of the sealing cover 62. A rectangular sealing joint can be installed to ensure sealing between the first 34 and the second 36 part of the connector body 28

Other alternatives of shapes of terminals can easily be chosen without departing from the present invention.

In use, the back leak fuel flows in the bore 22 and is able to enter the inner volume 38 of the connector body 28. Consequently, as represented on FIG. 2, the inner extremity 74, the electrical connection with the leads 16 and the portion of the terminal 68 that extend in the inner volume 38 of the connector body 28 can be immersed in fuel. As fuel chemically attacks copper (Cu) and zinc (Zn) said part of the terminal 68 should be made of conductive material free of Cu and free of Zn to avoid contaminating fuel. Aluminium is a preferred choice for making the terminal but other choices exist.

Figure 8:
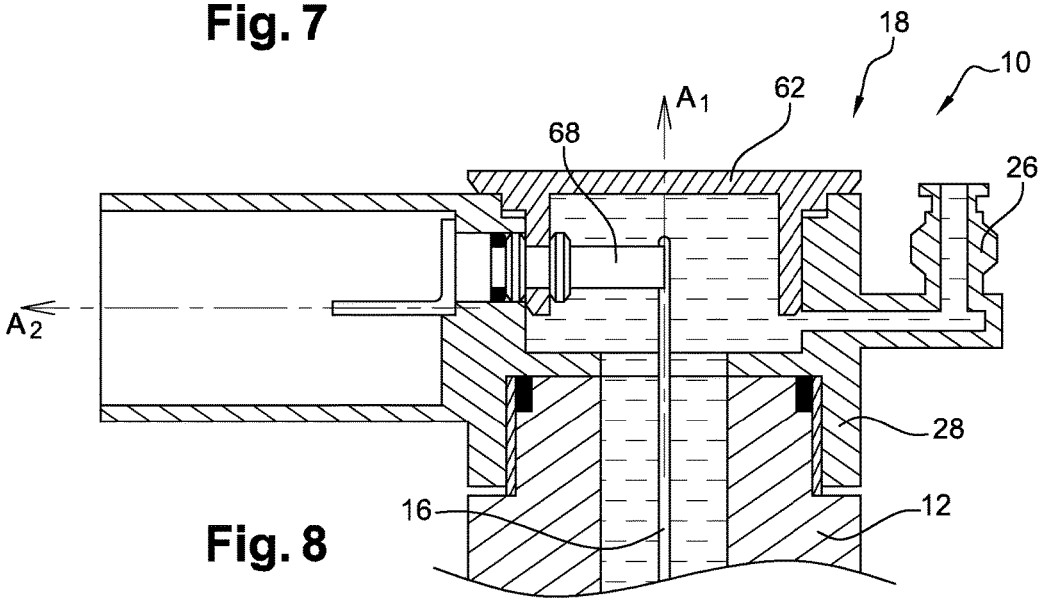
FIGS. 8 and 9 are other embodiments of the connector assembly.
Figure 9:
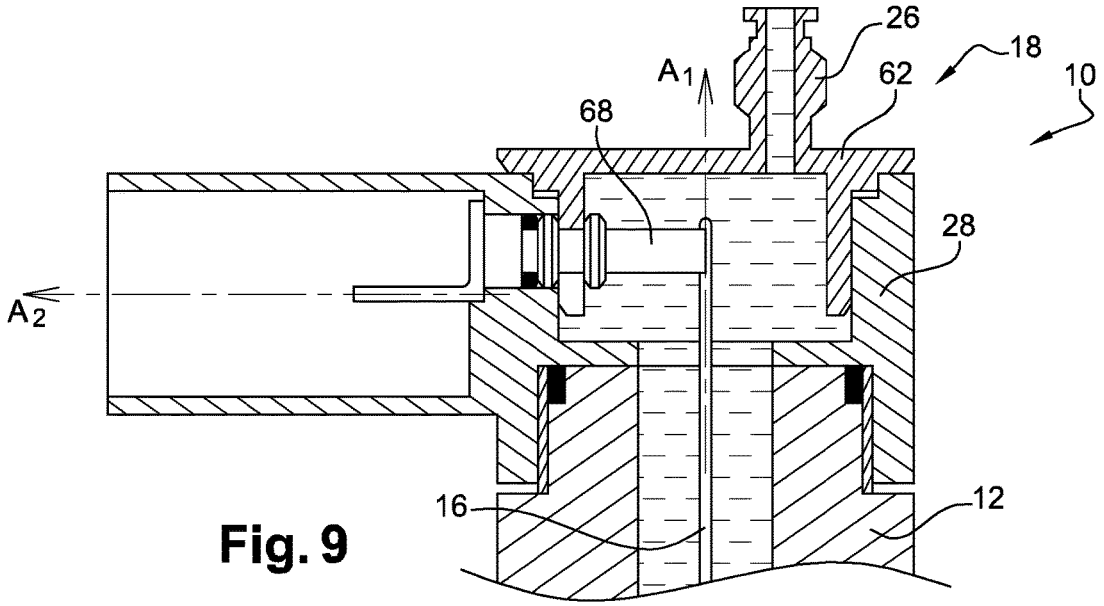

One of the major interests of the present invention is to enable to manufacture a through bore 22 in the injector body 12 opening in the top face 24. As fuel is now allowed to enter the connector body 28, another potential advantage is to arrange a plastic molded outlet pipe 26 integral to the connector body 12 or to the sealing cover 62, and remove from the injector body 12 the original outlet pipe as shown on FIG. 1. These two alternatives of location of outlet pipes 26 are illustrated on FIGS. 8 and 9.

First fixation means has been described in relation to FIG. 2 in having the protruding portion of the metal insert 56 welded onto the radial disc face 46 of the injector body 12.

Figure 10:
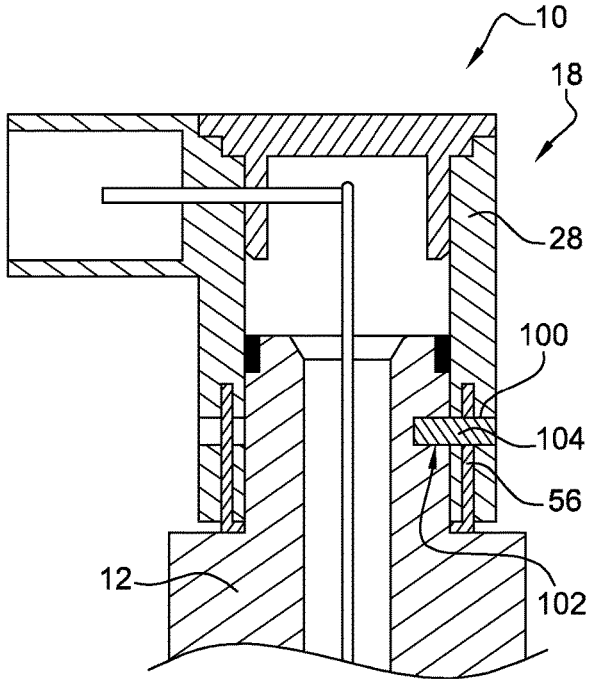
FIGS. 10 and 11 are two alternatives presenting fixation of the connector assembly onto the injector.
Figure 11:
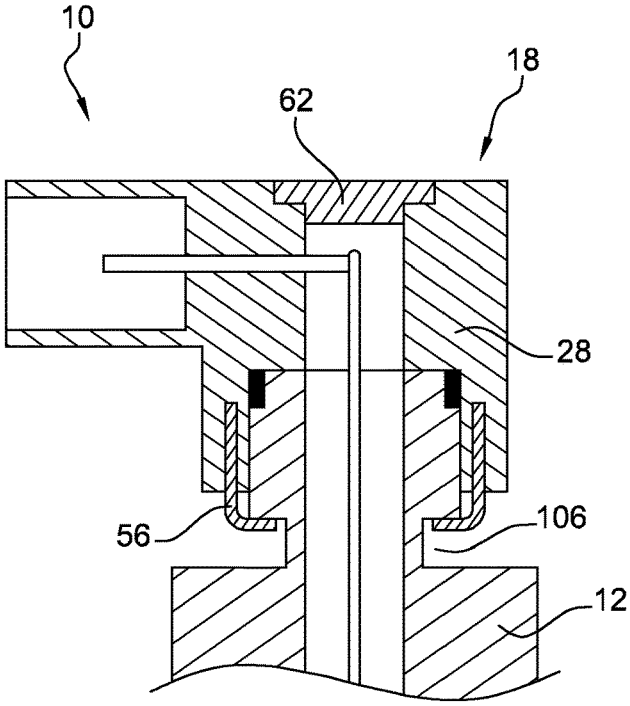

In reference to FIGS. 10 and 11 are now described two alternative means for fixing the connector assembly 18 on the injector body 12.

On FIG. 10, the connector assembly 18 is arranged over the upper end 20 of the injector in a male-female complementary engagement. In the engagement portion, the connector body 28 is provided with a radial through-hole 100 and, the injector body 12 is provided with a blind hole 102. When assembled in place, the two holes 100, 102, are aligned and a pin 104 is therein engaged fixing the connector assembly 18 on the injector body 12. As visible on FIG. 10, the connector body 28 can be provided with a plurality of through holes, two diametrally opposed holes are represented on the figure. This facilitates positioning of the connector on the injector and enables to choose the angular orientation of the connector on the injector without having to manage several connector bodies 28. Furthermore, the metal inserts 56 are represented and the radial pin 104 is engaged through said insert 56. This is not an obligation but it may help straightening the part. Also the downward protruding part or the insert 56, there represented inwardly bent may help to adjust the positioning of the connector by setting a height corresponding to the alignment of the holes 100, 102. Again, the hole 102 could, in an alternative, instead of being blind as in FIG. 10, be a through hole opening in the axial bore 22. In this case, to avoid any fuel leaks, the pin 104 should be made to ensure sealing of the hole 102 or, alternatively, other sealing means, such as a sealing paste, should finalize the sealing of the hole.

Another fixation alternative is represented on FIG. 11, where the upper end 20 of the injector body is provided with an annular groove 106 arranged at the intersection of the cylindrical wall 44 and of the radial disc-face 46. When in place, the protruding extremities of the metal inserts 56 are inwardly bent in said groove 106 so that the connector assembly is fixed. An advantage of such arrangement is to enable a continuous angular positioning of the connector over the injector body 12, while in the arrangement of FIG. 10 the plurality of holes 100 enables a discrete angular positioning.

The invention here above described further extends to the process of manufacturing and assembly of the injector 10.

Alternatives have been presented for positioning the outlet pipe 26, or for fixing the connector onto the injector body and anyone of these alternatives can be used in the process below. Also, the order of certain steps can be reversed without any issue.

In reference to the embodiment of FIG. 2, the connector body 28 is arranged in position over the upper end of the injector body 12 and is fixed in place using one of the fixing processes already described. Afterward, the electrical terminal 68 is inserted in the bore of the internal wall 32 by sliding the terminal from the outer volume 40 toward the inner volume 38, until the outer extremity 72 of the terminal engages the rotation locking means 84. The following step is to establish the permanent electrical connection between the inner extremity 74 of the terminal and the electrical leads 16 extending from the actuator 14. Said electrical connection can be done for instance via laser welding of the parts. This operation is made easy as the upper extremity 60 of the connector body being open the welding tool can be therein inserted. Finally the sealing cover 62 is arranged in position making sure that the translation locking means 94 is also engaged then, the sealing cover 62 is permanently fixed via ultrasonic laser welding or in using any other known technic such as gluing.

Alternative constructions are possible where instead of notches provided in the cover 62, the translation of the terminals along the second axis A2 can be prevented via a complementary shape of the internal wall 32.

Figure 12:
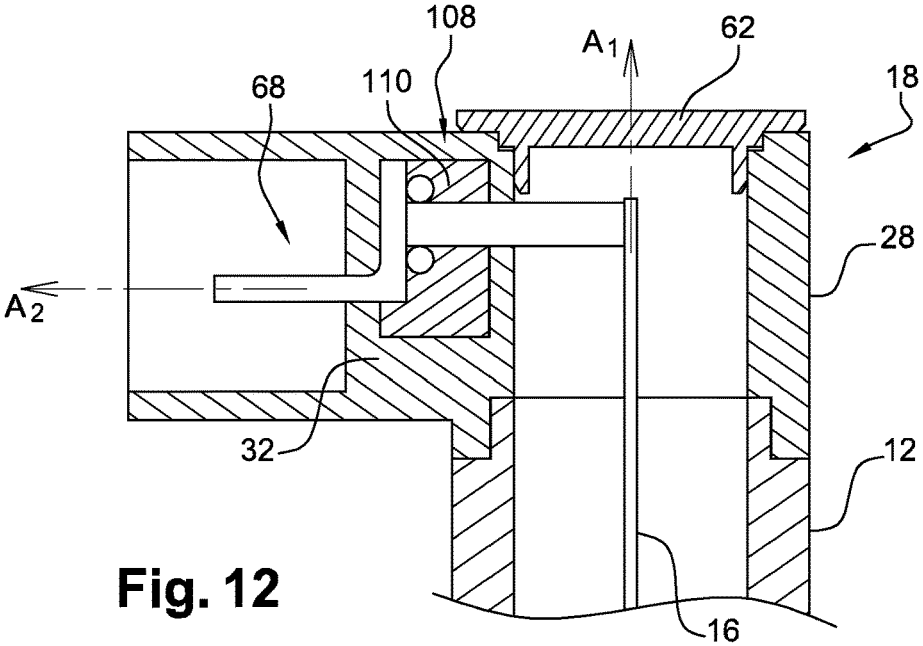
FIG. 12 is yet another alternative for fixing the electrical terminal in the connector body.

In a yet further alternative, the terminal 68 could be over-molded in the internal wall 32 either alone, or as part of a sub-assembly 108 as sketched on FIG. 12 wherein the terminal 68 is primary engaged in a plastic holder 110 along with O-ring 88. The sub-assembly 108 is afterward over-molded in the connector body 28.

The following references have been used in this description:

A1 first longitudinal axis
A2 second axis
10 fuel injector
12 injector body
14 actuator
16 electrical leads
18 electrical connector assembly
20 upper end of the injector body
22 bore
24 top end face of the injector body
26 outlet pipe
28 connector body
30 external envelop of the connector body
32 internal wall
34 first part of the connector body
36 second part of the connector body
38 inner volume
40 outer volume
42 lower extremity of the first part of the connector body
44 cylindrical face of the injector body
46 radial disc face
48 lower recess
50 female cylindrical wall of the connector body
52 ceiling wall
54 upper recess
56 metal insert
58 O-ring
60 upper extremity of the connector body
62 sealing cover
64 main face of the cover
66 centering wall of the cover
68 electrical terminal
70 bore in the internal wall
72 outer extremity of the terminal
74 inner extremity of the terminal
76 rectangular pin
78 connection portion
80 central portion of the terminal
82 small recess in the internal wall
84 rotation locking mean
86 sealing groove
88 O-ring
90 locking groove
92 notch
94 translation locking mean
96 final section of the terminal
98 notches in the flat terminal
100 radial through hole
102 blind hole
104 pin
106 annular groove
108 Sub-assembly terminal and sealing holder
110 sealing holder

The invention claimed is:

1. An electrical connector assembly of a fuel injector extending along a first axis, the electrical connector assembly comprising:

a connector body with external walls defining an inner volume and an internal wall dividing the connector body in a first part adapted to be fixed in a complementary engagement with a fuel injector body of the fuel injector and in a second part adapted to receive an electrical connector, wherein the fuel injector body includes a male face and the connector body includes a female wall which engages over the male face along the first axis, at least one electrical terminal extending through the internal wall, along a second axis, from an inner extremity protruding in the inner volume of the first part of the connector body, to an outer extremity protruding in an outer volume of the second part of the connector body, the outer extremity being shaped to receive in a complementary engagement an electrical terminal of said electrical connector, wherein the connector assembly is adapted to be in fluid communication with a back leak return conduit of the fuel injector so that, in use, fuel may enter the inner volume of the first part of the connector body and wet the at least one electrical terminal, wherein the inner volume of the first part of the connector body is substantially cylindrical extending along the first axis from a lower extremity, adapted to engage the fuel injector body, to an opposite upper extremity, said cylindrical volume opening at both extremities, the connector assembly further comprising a sealing cover adapted to seal the upper extremity.

2. A connector assembly as set in claim 1 further provided by an outlet pipe integral to the sealing cover, said pipe being adapted to be in fluid connection with the back leak return conduit of the fuel injector.

3. A connector assembly as set in claim 1 further provided by an outlet pipe integral to the connector body, said outlet pipe being adapted to be in fluid connection with the back leak return conduit of the fuel injector.

4. A connector assembly as set in claim 1, wherein a central portion of the at least one terminal that extends through the internal wall is cylindrical.

5. A connector assembly as set in claim 4 further comprising sealing means arranged between the central portion of the at least one terminal and the internal wall so that the inner and outer volumes of the first and of the second parts are sealed from each other.

6. A connector assembly as set in claim 4 wherein the inner extremity of the at least one terminal is integral to the central portion and is made in a first conductive material and wherein, the outer extremity is non-integral and is fixed to the central portion, the outer extremity being made in a second conductive material.

7. A connector assembly as set claim 6 wherein the first conductive material is free of Cu and of Zn.

8. A connector assembly as set in claim 6 wherein the first conductive material is externally coated with a coating free of Cu and of Zn.

9. A connector assembly as set in claim 4 wherein the inner and the outer extremities of the at least one terminal are both integral to the central portion and are all made in a first conductive material.

10. A connector assembly as set in claim 1 further comprising locking means adapted to maintain in position the at least one terminal relative to the connector body.

11. A connector assembly as set in claim 10 wherein said locking means comprise first means locking the terminal in rotation about the second axis and also, second means locking the terminal in translation along said second axis.

12. A connector assembly as set in claim 10 wherein:

the inner volume of the first part of the connector body is substantially cylindrical extending along the first axis from a lower extremity, adapted to engage the fuel injector body, to an opposite upper extremity, said cylindrical volume opening at both extremities, the connector assembly further comprising a sealing cover adapted to seal the upper extremity; and the locking means comprise a complementary engagement of a portion of the terminal and of part of the sealing cover.

13. A connector assembly as set claim 10 wherein said locking means comprises a sub-assembly of the terminal complementary engaged in a holding part, said sub-assembly being over-molded in the connector body.

14. A connector assembly as set in claim 1 further comprising connector locking means adapted to fix the connector assembly on the fuel injector body.

15. A connector assembly as set in claim 14 wherein the locking means comprise at least one metal insert fixed to the connector body, axially protruding from the connector body at the periphery of the lower extremity.

16. A connector assembly as set in claim 15 wherein the at least one metal insert is over molded in the connector body, or are glued on the outer periphery of the connector body or are crimped on the periphery of the connector body by a circling collar.

17. A fuel injector comprising:

a fuel injector body extending along a first axis and including a male face, an actuator arranged in said fuel injector body, and an electrical connector assembly arranged on said fuel injector body and comprising: a connector body with external walls defining an inner volume and an internal wall dividing the connector body in a first part adapted to be fixed in a complementary engagement with the fuel injector body and in a second part adapted to receive an electrical connector, wherein a female wall of the first part of the connector body engages over the male face of the injector body along the first axis, at least one electrical terminal extending through the internal wall, along a second axis, from an inner extremity protruding in the inner volume of the first part of the connector body, to an outer extremity protruding in an outer volume of the second part of the connector body, the outer extremity being shaped to receive in a complementary engagement an electrical terminal of said electrical connector, the fuel injector body having an internal bore in which at least one electrical lead extends from the actuator to the electrical connector assembly wherein it is electrically connected to one of said at least one electrical terminal, the internal bore being part of a back leak return channel in which, in use, low pressure fuel may flow toward an outlet, the inner volume of the first part of the electrical connector assembly being in fluid communication with the internal bore of the fuel injector body so that, in use, fuel may enter the inner volume of the electrical connector assembly and wet the at least one electrical terminal, wherein the inner volume of the first part of the connector body is substantially cylindrical extending along the first axis from a lower extremity, adapted to engage the fuel injector body, to an opposite upper extremity, said cylindrical volume opening at both extremities, the connector assembly further comprising a sealing cover adapted to seal the upper extremity.

18. A fuel injector as set in claim 17 wherein the at least one electrical lead is laser welded on the inner extremity of the at least one terminal.

19. A fuel injector as set in claim 18 wherein:

the connector assembly further comprises a locking means adapted to maintain in position the at least one terminal relative to the connector body, said locking means comprising a sub-assembly of the terminal complementary engaged in a holding part, said sub-assembly being over-molded in the connector body, and wherein the fuel injector body has a male cylindrical portion that engages in a complementary female lower extremity of the connector body and wherein the fuel injector body is provided with an annular groove in which are bent the protruding part of the metal insert so that, the connector assembly is fixed in position on the fuel injector body.

20. A fuel injector as set in claim 17 wherein:

the connector assembly further comprises a locking means adapted to maintain in position the at least one terminal relative to the connector body, said locking means comprising a sub-assembly of the terminal complementary engaged in a holding part, said sub-assembly being over-molded in the connector body, and the fuel injector body has a male cylindrical portion that engages in a complementary female lower extremity of the connector body and wherein the fuel injector body is provided with an annular disc face transversal to the first axis, the protruding part of the metal insert being welded on said disc-face so that, the connector assembly is fixed in position on the fuel injector body.

21. A fuel injector as set in claim 17 wherein:

the connector assembly further comprises a locking means adapted to maintain in position the at least one terminal relative to the connector body, said locking means comprising a sub-assembly of the terminal complementary engaged in a holding part, said sub-assembly being over-molded in the connector body, and the fuel injector body has a male cylindrical portion that engages in a complementary female lower extremity of the connector body, both the connector body and the fuel injector body being provided with complementary aligned radial holes and in which is inserted a pin so that, the connector assembly is fixed in position on the fuel injector body.

* * * * *